United States Patent [19]

Cook

[11] Patent Number: 4,827,884

[45] Date of Patent: May 9, 1989

[54] THROTTLE ASSEMBLY

[75] Inventor: John E. Cook, Chatham, Canada

[73] Assignee: Bendix Electronics Limited, Chatham, Canada

[21] Appl. No.: 104,798

[22] Filed: Oct. 2, 1987

[51] Int. Cl.[4] ..... F02D 9/10

[52] U.S. Cl. ..... 123/336; 123/361

[58] Field of Search ..... 123/327, 336, 337, 361, 123/399, 585, 586, 339; 261/65

[56] References Cited

U.S. PATENT DOCUMENTS

| | | | |
|---|---|---|---|
| 3,866,583 | 2/1975 | Pundt et al. | 123/327 X |
| 4,084,558 | 4/1978 | Hattori et al. | 123/327 |
| 4,158,352 | 6/1979 | Blatter | 123/327 X |
| 4,408,581 | 10/1983 | Pfalzgraf et al. | 123/586 X |

FOREIGN PATENT DOCUMENTS

| | | | |
|---|---|---|---|
| 801674 | 8/1936 | France | 123/336 |
| 216036 | 10/1985 | Japan | 123/327 |

*Primary Examiner*—Tony M. Argenbright

*Attorney, Agent, or Firm*—Russel C. Wells

[57] ABSTRACT

A throttle assembly (10) for an engine comprising: a primary throttle plate (16) rotatably mounted on a first shaft (18); linkage (22) for rotating the first shaft (18) in response to operator demand; a second throttle plate (42) received within a cut-out (30) formed in the first throttle plate and rotatably mounted relative to the first shaft; and an actuator (50) for rotating the second throttle plate relative to the first throttle plate to adjust the flow area of a second flow passage formed between the first and second throttle plates.

10 Claims, 1 Drawing Sheet

FIG. 1
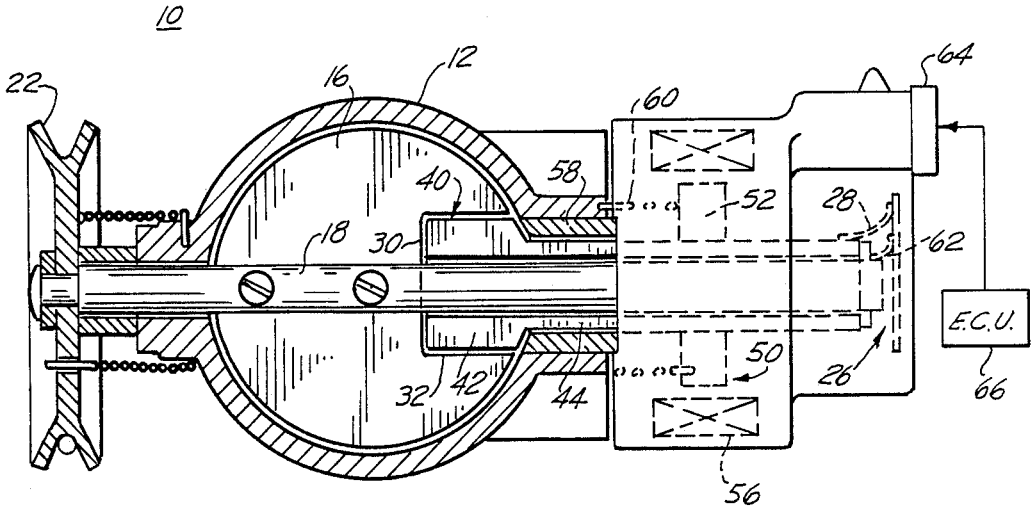
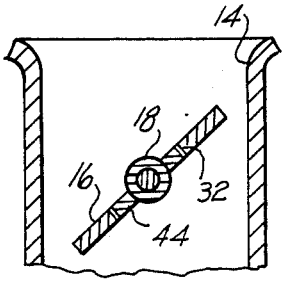
FIG. 3
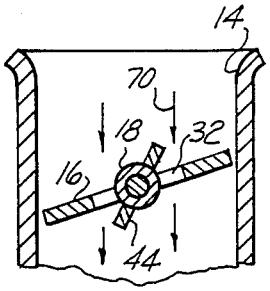
FIG. 2

THROTTLE ASSEMBLY

BACKGROUND AND SUMMARY OF THE INVENTION

This invention relates to a throttle assembly for controlling the supply of air to an engine and for providing idle air control during periods when the engine is idling.

In order to ensure proper control of vehicle engine emissions, and maximize fuel economy, modern automotive vehicles idle at relatively low engine speeds. However, when vehicle assessories are switched on, a slowly idling engine may stall. Accordingly, it is necessary to provide a device which permits engine idle speed to vary as a function of the load on the engine. Characteristic of these prior devices are idle bypass valves. These devices open and close a passage, formed in a throttle body, extending around the throttle plate to "bypass" air about the throttle plate during instances when the throttle plate is substantially closed. Illustrative of one of these prior devices is the commonly assigned U.S. Pat. No. 4,388,856. Another prior device is the vacuum actuator disclosed in U.S. Pat. No. 4,448,659.

Accordingly, the present invention comprises: a throttle assembly comprising: means for establishing an air intake passage; means for controlling the flow of air to an engine. Such air flow control means including primary means, rotatably mounted in the passage means, and rotatable from a substantially closed position at engine idle speed conditions, to a substantially open position at wide open throttle conditions, for varying the flow area of the passage means and secondary means, rotatably mounted relative to the primary means, for varying the flow area of a secondary air flow passage to permit air to flow directly across and through such primary means. More specifically the invention comprises: a throttle assembly for an engine including:

a primary throttle plate rotatably mounted on a first shaft; means for rotating the first shaft in response to operator demand; a second throttle plate received within a cut-out formed in the first throttle plate and rotatably mounted relative to the first shaft; and means for rotating the second throttle plate relative to the first throttle plate.

Many other objects and purposes of the invention will be clear from the following detailed description of the drawings.

BRIEF DESCRIPTION OF THE DRAWINGS

In the drawings:

FIG. 1 is a schematic view of the present invention.

FIG. 2 is a cross-sectional view of the present invention shown when the engine is at idle condition.

FIG. 3 illustrates the present invention in an off-idle condition.

DETAILED DESCRIPTION OF THE DRAWINGS

Reference is made to FIG. 1 which illustrates a throttle assembly 10. The throttle assembly 10 includes a throttle body 12. Such throttle body 12 is typically positioned between an air intake of the engine and its intake manifold. The throttle body includes an air passage generally shown at 14. Positioned within the throttle body 12 is primary means for controlling the flow area through the passage 14. Such primary means including a primary throttle plate 16. The primary throttle plate is mounted to a first shaft 18 which is supported at either end and is free to rotate. The primary throttle plate 16 is actuated in a known manner through linkage 22 in response to the movement of the accelerator pedal. A throttle position sensor generally shown as 26 is linked to one end of the shaft 18, such sensor 26 may be of the known resistive wiper variety having a wiper 28. Positioned within the passage 14 and rotatably situated relative to the primary throttle plate 16 is a second air flow control device generally shown as 40. The second device 40 is used to vary the flow area of a secondary air flow passage 32 to permit air to flow directly across the primary throttle plate.

In the embodiment illustrated in FIG. 1, the secondary air flow device includes a second throttle plate 42. The second passage 32 is formed between the second throttle plate 42 and a cut-out 30 in the primary throttle plate 16. As can be seen in the FIGURES the second throttle plate 42 is received in the cut-out 30 and as the second throttle 42 is rotated relative to the primary throttle plate 16 the effective flow area of the secondary passage 32 is varied.

The second throttle plate 42 extends radially from a hollow shaft 44. The hollow shaft 44 and plate 42 are rotatably mounted about the first shaft 18. The second shaft 44 may also support the right hand side of the first shaft 18 eliminating the need for a bearing or bushing. The hollow shaft 44 is received within an electric rotary actuator such as a torque motor or rotary solenoid which is generally illustrated as 50. The actuator 50 includes an armature 52 operatively attached to the hollow shaft 44 and a stator (not shown) and a coil 56 which is fixedly positioned about the armature 52. The armature 52 and shaft 44 are appropriately supported by the throttle body 12 or by bearings or bushings 58. The second shaft 44 is also operatively connected to the sensor 26 by another wiper 62 to generate a signal indicative of the angular position of the second shaft. Communication between the two sensor output signals and activation of the actuator 50 is achieved through a connector assembly 64. A torsion spring 60 bears against the armature 52 or second shaft 44. The spring 62 is configured to bias the second shaft 44 towards a zero or idle position. The spring 60 is useful for fail-safe operation, that is, if the actuator 50 fails the second throttle plate 42 will be rotated to a position to minimize the idle bypass function.

The operation of the present invention is as follows. Reference is made to FIG. 2 which illustrates the primary throttle plate 16 in an idle speed position. This idle speed position is set by a calibration screw in a known manner and severely restricts the flow of air to the engine. By way of digression, in prior systems utilizing idle air bypass valves, ports and passages are fabricated in the throttle body or carburator body to communicate additional air around the closed primary throttle plate 16 in response to increased engine demands. In contrast, the present invention does not employ such additional ports and passages. In response to control signals from the ECU 66, the actuator 50 rotates the hollow shaft 44 relative to the first shaft 18 to a position to achieve the necessary additional air flow to increase engine speed in response to engine parameters. This motion displaces the second throttle plate 42 from the primary throttle plate permitting air, designated by arrow 70, to flow across the primary throttle plate 16 through the passage 32.

Reference is briefly made to FIG. 3 which illustrates an off-idle position of the primary throttle plate 16. The primary throttle plate 16 is moved to this and other off-idle positions in response to the movement of the linkage 22 in a known manner. With the primary throttle plate moved away from the idle position, the rotary actuator 50 is typically activated thereby permitting the second throttle plate 42 to move into approximate alignment with the primary throttle plate 16. With the two throttle plates in virtual alignment, the amount of air received by the engine is determined by the relative position of the primary throttle plate 16 relative to the throttle body. It is not necessary to the invention to cause the second throttle plate to follow the motion of the primary throttle plate 16, as it is moved from idle. This is because that as the primary throttle plate is rotated from its idle position to wide open throttle the amount of air flowing into the engine will primarily depend upon the position of the primary throttle since it controls a substantially greater flow area. Further, if the actuator 50 is a torque motor the second throttle plate may physically not be able to follow the primary throttle plate to its wide open position since many torque motors can only rotate through an angle of 50–70 degrees.

Upon deceleration the primary throttle plate will be moved toward its idle condition by the linkage 22 in a known manner. BY measuring the position of the first shaft 18, the actuator can be controlled to cause the second throttle plate to track the motion of the primary throttle plate as it moves toward idle. Alternatively, the primary throttle plate can be permitted to over-travel the position of the second throttle plate 42, after a predetermined time delay and at a predetermined rate the actuator 50 can rotate the second throttle plate 42 to idle to achieve a smooth, controlled deceleration of the engine.

Many changes and modifications in the above described embodiment of the invention can, of course, be carried out without departing from the scope thereof. Accordingly, that scope is intended to be limited only by the scope of the appended claims.

I claim:

1. A throttle assembly for an engine comprising:

a primary throttle plate mounted on a first shaft and rotatable from an idle position at engine idle to a wide open throttle position to control air flow to the engine;

first means for rotating the first shaft in response to operator demand;

a second throttle plate received with a cut-out formed in the first throttle plate and rotatably mounted relative to the first shaft to permit bypass air flow across the primary throttle plate;

and second means for rotating the second throttle plate relative to the first throttle plate including an electrical rotary actuator responsive to a control signal;

wherein said second means includes means for measuring the position of the second throttle plate.

2. The assembly as defined in claim 1 wherein the first means includes means for measuring the rotation of the primary throttle plate.

3. The assembly as defined in claim 2 wherein the second means includes a torsion spring for urging the second throttle plate towards its idle position.

4. The assembly as defined in claim 3 wherein the second means is operative to rotate the second throttle plate to a first position relative to the primary throttle plate during engine idle condition to minimize the bypass air flow and to rotate the second throttle plate to a second position relative to the primary throttle plate, during instances when the primary throttle plate is in its idle position to control the bypass air flow in response to at least one engine parameter.

5. The assembly as defined in claim 4 wherein the second means is operative to maintain the second throttle plate at its second position while the primary throttle plate is opening.

6. The assembly as defined in claim 4 wherein the second means is operative to maintain the second throttle plate at its second position while the primary throttle plate is opening and to cause the second throttle plate to track the position of the primary throttle plate after the primary throttle plate has moved to a position corresponding to the second position of the second throttle plate.

7. The assembly as defined in claim 5 during periods of engine deceleration, the second means is operative to cause the second throttle plate to follow the motion of the primary throttle plate as it moves past the second position to idle.

8. The assembly as defined in claim 7 wherein the second means is operative to cause the second throttle plate to follow the position of the primary throttle plate after a predetermined time delay and at a predetermined rate to control engine deceleration.

9. A throttle assembly comprising:

means for establishing an air intake passage;

means for controlling the flow of air to an engine including primary means, rotatably mounted in the passage means, and rotatable from a substantially closed position at engine idle speed conditions, to a substantially open position at wide open throttle conditions, for varying the flow area of the passage means;

secondary means, rotatably mounted relative to the primary means, for varying the flow area of a secondary air flow passage to permit air to flow directly across and through such primary means, wherein the secondary means includes means for increasing the flow area of the secondary air flow passage during periods when the passage means is substantially closed by the primary means, and wherein the means for increasing includes means for determining that the primary means is at a position corresponding to engine idle and means for rotating the secondary means relative to the primary means, and means effective during non-idle conditions, for urging the secondary means to follow the primary means such that the secondary passage is maintained substantially closed.

10. A throttle assembly comprising:

means for establishing an air intake passage;

means for controlling the flow of air to an engine, including primary means, rotatably mounted in the passage means, and rotatable from a substantially closed position at engine idle speed conditions, to a substantially open position at wide open throttle conditions, for varying the flow area of the passage means;

secondary means, rotatably mounted relative to the primary means, for varying the flow area of a secondary air flow passage to permit to flow directly across and through such primary means, and means effective during non-idle conditions, for urging the secondary means to follow the primary means such that the secondary passage is maintained substantially closed.

* * * * *